US006744978B2

(12) United States Patent
Tweedy et al.

(10) Patent No.: US 6,744,978 B2
(45) Date of Patent: Jun. 1, 2004

(54) SMALL DIAMETER LOW WATT DENSITY IMMERSION HEATING ELEMENT

(75) Inventors: Clifford D. Tweedy, St. Charles, MO (US); Theodore VonArx, La Crescent, MN (US)

(73) Assignee: Watlow Polymer Technologies, Winona, MN (US)

( * ) Notice: Subject to any disclaimer, the term of this patent is extended or adjusted under 35 U.S.C. 154(b) by 160 days.

(21) Appl. No.: 09/908,863

(22) Filed: Jul. 19, 2001

(65) Prior Publication Data

US 2002/0127006 A1 Sep. 12, 2002

Related U.S. Application Data

(63) Continuation-in-part of application No. 09/756,162, filed on Jan. 8, 2001.

(51) Int. Cl.[7] ..... H05B 3/78
(52) U.S. Cl. ..... 392/451; 219/494
(58) Field of Search ..... 392/465, 466, 392/451, 459, 485, 487; 219/481, 490, 494

(56) References Cited

U.S. PATENT DOCUMENTS

| | | | | |
|---|---|---|---|---|
| 1,043,922 | A | 11/1912 | Gold | 219/523 |
| 1,046,465 | A | 12/1912 | Hoyt | |
| 1,058,270 | A | 4/1913 | Stephens | 219/217 |
| 1,281,157 | A | 10/1918 | Hadaway, Jr. | |
| 1,477,602 | A | 12/1923 | Simon | |
| 1,674,488 | A | 6/1928 | Tang | |
| 1,987,119 | A | 1/1935 | Long | 219/39 |
| 1,992,593 | A | 2/1935 | Whitney | 219/46 |
| 2,146,402 | A | 2/1939 | Morgan | 219/523 |
| 2,202,095 | A | 5/1940 | Delhaye et al. | 219/217 |
| 2,274,445 | A | 2/1942 | Greer | 219/38 |
| 2,426,976 | A | 9/1947 | Taulman | 219/19 |
| 2,456,343 | A | 12/1948 | Tuttle | 201/67 |
| 2,464,052 | A | 3/1949 | Numrich | 219/38 |

(List continued on next page.)

FOREIGN PATENT DOCUMENTS

| | | |
|---|---|---|
| DE | 35 12 659 A | 9/1986 |
| DE | 3512659 | 10/1986 |
| DE | 38 36 387 C1 | 5/1990 |
| GB | 14562 | 9/1913 |
| GB | 1070849 | 6/1967 |
| GB | 1325084 | 8/1973 |
| GB | 1498792 | 1/1978 |
| GB | 2244898 | 12/1999 |
| JP | 53-134245 | 11/1978 |
| JP | 3-129694 | 6/1991 |
| JP | 07 211438 A | 11/1995 |

OTHER PUBLICATIONS

"Polymers", *Guide to Selecting Engineered Materials*, a special issue of *Advanced Materials & Processes*, Metals Park, OH, ASM International, 1989, pp. 92–93.

(List continued on next page.)

*Primary Examiner*—Thor Campbell
(74) *Attorney, Agent, or Firm*—Duane Morris LLP

(57) ABSTRACT

The present invention provides immersion heating elements, water heaters and methods for their fabrication and use. In the first embodiment of this invention, a resistance heating element is provided which includes a resistance heating material and an electrically insulating, substantially water impervious sheath disposed over the resistance heating material to form an active element portion having an envelope of about 50 in$^3$, a total wattage of at least 1000 W, and a watt density of no greater than 60 W/in$^2$. Such an element has been demonstrated to substantially reduce scale reduction in water containing calcium, calcium carbonate, or both in solution.

21 Claims, 3 Drawing Sheets

U.S. PATENT DOCUMENTS

| | | | | |
|---|---|---|---|---|
| 2,593,087 | A | 4/1952 | Baggett | 219/217 |
| 2,593,459 | A | 4/1952 | Johnson | 219/39 |
| 2,710,909 | A | 6/1955 | Logan et al. | 219/46 |
| 2,719,907 | A | 10/1955 | Combs | 219/46 |
| 2,804,533 | A | 8/1957 | Nathanson | 219/522 |
| 2,889,439 | A | 6/1959 | Musgrave | 219/19 |
| 2,938,992 | A | 5/1960 | Crump | 219/46 |
| 3,061,501 | A | 10/1962 | Dittman et al. | 156/250 |
| 3,173,419 | A | 3/1965 | Dubilier et al. | 128/399 |
| 3,191,005 | A | 6/1965 | Cox | 219/528 |
| 3,201,738 | A | 8/1965 | Mitoff | 338/238 |
| 3,211,203 | A | 10/1965 | Creed et al. | 146/81 |
| 3,238,489 | A | 3/1966 | Hay | 388/250 |
| 3,268,846 | A | 8/1966 | Morey | 338/212 |
| 3,296,415 | A | 1/1967 | Eisler | 219/385 |
| 3,352,999 | A | 11/1967 | Macoicz et al. | 219/321 |
| 3,374,338 | A | 3/1968 | Morey | 219/529 |
| 3,385,959 | A | 5/1968 | Ames et al. | |
| 3,496,517 | A | 2/1970 | Walter | 339/18 |
| 3,564,589 | A | 2/1971 | Arak | 219/331 |
| 3,573,430 | A | 4/1971 | Eisler | 219/385 |
| 3,597,591 | A | 8/1971 | Van Derlip | 219/528 |
| 3,614,386 | A | 10/1971 | Hepplewhite | 219/312 |
| 3,621,566 | A | * 11/1971 | Welsh | 29/610.1 |
| 3,623,471 | A | 11/1971 | Bogue et al. | 126/263.01 |
| 3,648,659 | A | 3/1972 | Jones | 119/1 |
| 3,657,516 | A | 4/1972 | Fujihara | 219/345 |
| 3,657,517 | A | 4/1972 | Hoyt | 219/535 |
| D224,406 | S | 7/1972 | Heck | D26/1 |
| 3,678,248 | A | 7/1972 | Ticault et al. | 219/525 |
| 3,683,361 | A | 8/1972 | Salzwedel | 338/322 |
| 3,686,472 | A | 8/1972 | Harris | 219/213 |
| 3,707,618 | A | 12/1972 | Zeitlin et al. | 219/336 |
| 3,725,645 | A | 4/1973 | Shevlin | 219/521 |
| 3,781,526 | A | 12/1973 | Damron | 219/538 |
| 3,831,129 | A | 8/1974 | Frey | 339/19 |
| 3,860,787 | A | 1/1975 | Strobach | 219/336 |
| 3,878,362 | A | 4/1975 | Stinger | 219/528 |
| 3,888,711 | A | 6/1975 | Breitner | 156/93 |
| 3,908,749 | A | 9/1975 | Williams | 165/2 |
| 3,927,300 | A | 12/1975 | Wada et al. | 219/381 |
| 3,933,550 | A | 1/1976 | Erwin | 156/85 |
| 3,943,328 | A | 3/1976 | Cunningham | 219/335 |
| 3,952,182 | A | 4/1976 | Flanders | 219/309 |
| 3,968,348 | A | 7/1976 | Stanfield | 219/535 |
| 3,974,358 | A | 8/1976 | Goltsos | 219/387 |
| 3,976,855 | A | 8/1976 | Altmann et al. | 219/532 |
| 3,985,928 | A | 10/1976 | Watanabe et al. | 428/273 |
| 3,987,275 | A | 10/1976 | Hurko | 219/461 |
| 4,021,642 | A | 5/1977 | Fields, Jr. | 219/391 |
| 4,038,519 | A | 7/1977 | Foucras | 219/301 |
| 4,046,989 | A | 9/1977 | Parise et al. | 219/437 |
| 4,058,702 | A | 11/1977 | Jerles | 219/321 |
| 4,068,115 | A | 1/1978 | Mack et al. | 219/386 |
| 4,083,355 | A | 4/1978 | Schwank | 126/39 J |
| 4,094,297 | A | 6/1978 | Ballentine | 126/39 J |
| 4,102,256 | A | 7/1978 | John et al. | 99/372 |
| 4,112,410 | A | 9/1978 | Wrob et al. | 338/243 |
| 4,117,311 | A | 9/1978 | Sturm | 219/544 |
| 4,119,834 | A | 10/1978 | Losch | 392/418 |
| 4,152,578 | A | 5/1979 | Jacobs | 219/336 |
| 4,158,078 | A | 6/1979 | Egger et al. | 428/102 |
| 4,176,274 | A | 11/1979 | Lippera | 219/522 |
| 4,186,294 | A | 1/1980 | Bender | 219/527 |
| 4,201,184 | A | 5/1980 | Scheidler et al. | 126/39 J |
| 4,217,483 | A | 8/1980 | Vogel et al. | 219/541 |
| 4,224,505 | A | 9/1980 | Sturm | 219/544 |
| 4,233,495 | A | 11/1980 | Scoville et al. | 219/386 |
| 4,245,149 | A | 1/1981 | Fairlie | 219/528 |
| 4,272,673 | A | 6/1981 | Semanaz et al. | 219/544 |
| 4,294,643 | A | 10/1981 | Tadewald | 156/293 |
| 4,296,311 | A | 10/1981 | Hagglund et al. | 219/464 |
| 4,304,987 | A | 12/1981 | van Konynenburg | 219/553 |
| 4,313,053 | A | 1/1982 | Sturm | 219/544 |
| 4,313,777 | A | 2/1982 | Buckley et al. | 156/272 |
| 4,321,296 | A | 3/1982 | Rougier | 428/212 |
| 4,326,121 | A | 4/1982 | Welsby et al. | 219/523 |
| 4,334,146 | A | 6/1982 | Sturm | 219/492 |
| 4,337,182 | A | 6/1982 | Needham | 524/609 |
| 4,346,277 | A | 8/1982 | Wojtecki et al. | 219/528 |
| 4,346,287 | A | 8/1982 | Desloge | 219/541 |
| 4,349,219 | A | 9/1982 | Sturm | 285/21 |
| 4,354,096 | A | 10/1982 | Dumas | 219/523 |
| 4,358,552 | A | 11/1982 | Shinohara et al. | 523/443 |
| 4,364,308 | A | 12/1982 | John et al. | 99/351 |
| 4,375,591 | A | 3/1983 | Sturm | 219/544 |
| 4,387,293 | A | 6/1983 | Grice et al. | 219/529 |
| 4,388,607 | A | 6/1983 | Toy et al. | 338/22 SD |
| 4,390,551 | A | 6/1983 | Swartley et al. | 426/107 |
| 4,419,567 | A | 12/1983 | Murphy et al. | 219/336 |
| 4,429,215 | A | 1/1984 | Sakai et al. | 219/528 |
| 4,436,988 | A | 3/1984 | Blumenkranz | 219/544 |
| 4,482,239 | A | 11/1984 | Hosono et al. | 355/3 |
| 4,493,985 | A | 1/1985 | Keller | 219/535 |
| 4,501,951 | A | 2/1985 | Benin et al. | 219/243 |
| 4,530,521 | A | 7/1985 | Nyffeler et al. | 285/21 |
| 4,540,479 | A | 9/1985 | Sakurai et al. | 204/427 |
| 4,606,787 | A | 8/1986 | Pelligrino | 156/632 |
| 4,633,063 | A | 12/1986 | Willis | 219/243 |
| 4,640,226 | A | 2/1987 | Liff | 119/1 |
| 4,641,012 | A | 2/1987 | Roberts | 219/331 |
| 4,658,121 | A | 4/1987 | Horsma et al. | 219/553 |
| 4,687,905 | A | 8/1987 | Cunningham et al. | 219/336 |
| 4,703,150 | A | 10/1987 | Kunnecke et al. | 219/535 |
| 4,707,590 | A | 11/1987 | Lefebvre | 219/523 |
| 4,725,717 | A | 2/1988 | Harrison | 219/528 |
| 4,730,148 | A | 3/1988 | Nakata | 315/397 |
| 4,751,528 | A | 6/1988 | Spehrley, Jr. et al. | 346/140 |
| 4,756,781 | A | 7/1988 | Etheridge | 156/85 |
| 4,762,980 | A | 8/1988 | Insley | 219/307 |
| 4,784,054 | A | 11/1988 | Karos et al. | 99/483 |
| 4,797,537 | A | 1/1989 | Berthelius et al. | 219/528 |
| 4,845,343 | A | 7/1989 | Aune et al. | 219/545 |
| 4,860,434 | A | 8/1989 | Louison et al. | 29/611 |
| 4,865,014 | A | 9/1989 | Nelson | 126/361 |
| 4,865,674 | A | 9/1989 | Durkin | 156/158 |
| 4,866,252 | A | 9/1989 | Van Loo et al. | 219/535 |
| 4,904,845 | A | 2/1990 | Wonka | 219/280 |
| 4,913,666 | A | 4/1990 | Murphy | 439/709 |
| 4,927,999 | A | 5/1990 | Hanselka | 219/535 |
| 4,948,948 | A | 8/1990 | Lesage | 219/329 |
| 4,956,138 | A | 9/1990 | Barfield | 264/129 |
| 4,970,528 | A | 11/1990 | Beaufort et al. | 346/25 |
| 4,972,197 | A | 11/1990 | McCauley et al. | 343/704 |
| 4,982,064 | A | 1/1991 | Hartman et al. | 219/727 |
| 4,983,814 | A | 1/1991 | Ohgushi et al. | 219/545 |
| 4,986,870 | A | 1/1991 | Frohlich | 156/382 |
| 4,993,401 | A | 2/1991 | Diekmann et al. | 126/39 |
| 5,003,693 | A | 4/1991 | Atkinson et al. | 29/849 |
| 5,013,890 | A | 5/1991 | Gamble | 392/497 |
| 5,021,805 | A | 6/1991 | Imaizumi et al. | 346/76 R |
| 5,023,433 | A | 6/1991 | Gordon | 219/548 |
| 5,038,458 | A | 8/1991 | Wagoner et al. | 29/593 |
| 5,041,846 | A | 8/1991 | Vincent et al. | 346/25 |
| 5,051,275 | A | 9/1991 | Wong | 427/58 |
| 5,066,852 | A | 11/1991 | Willbanks | 219/544 |
| 5,068,518 | A | 11/1991 | Yasuda | 219/549 |
| 5,111,025 | A | 5/1992 | Barma et al. | 29/217 |
| 5,113,480 | A | 5/1992 | Murphy et al. | 392/501 |
| 5,129,033 | A | 7/1992 | Ferrara et al. | 392/447 |
| 5,136,143 | A | 8/1992 | Kutner et al. | 219/544 |

| | | | | |
|---|---|---|---|---|
| 5,155,800 | A | 10/1992 | Rezabek et al. | 382/503 |
| 5,162,634 | A | 11/1992 | Kusaka et al. | 219/216 |
| 5,184,969 | A | 2/1993 | Sharpless et al. | 445/24 |
| 5,208,080 | A | 5/1993 | Gajewski et al. | 428/1 |
| 5,221,419 | A | 6/1993 | Beckett | 156/630 |
| 5,221,810 | A | 6/1993 | Spahn | 102/475 |
| 5,237,155 | A | 8/1993 | Hill | 219/544 |
| 5,252,157 | A | 10/1993 | Inhofe, Jr. | 156/158 |
| 5,255,595 | A | 10/1993 | Higgins | 99/378 |
| 5,255,942 | A | 10/1993 | Kenworthy | 285/21 |
| 5,287,123 | A | 2/1994 | Medin et al. | 346/140 R |
| 5,293,446 | A | 3/1994 | Owens et al. | 392/449 |
| 5,300,760 | A | 4/1994 | Batliwalla et al. | 219/549 |
| 5,302,807 | A | 4/1994 | Zhao | 219/211 |
| 5,304,778 | A | 4/1994 | Dasgupta et al. | 219/270 |
| 5,313,034 | A | 5/1994 | Grimm | 156/274.2 |
| 5,389,184 | A | 2/1995 | Jacaruso et al. | 156/378 |
| 5,397,873 | A | 3/1995 | Stoops et al. | 219/450 |
| 5,406,316 | A | 4/1995 | Schwiebert et al. | 347/18 |
| 5,406,321 | A | 4/1995 | Schwiebert et al. | 347/102 |
| 5,408,070 | A | 4/1995 | Hyllberg | 392/503 |
| 5,453,599 | A | 9/1995 | Hall, Jr. | 219/544 |
| 5,461,408 | A | 10/1995 | Giles et al. | 347/102 |
| 5,476,562 | A | 12/1995 | Inhofe, Jr. | 156/156 |
| 5,477,033 | A | 12/1995 | Bergholtz | 219/549 |
| 5,497,883 | A | 3/1996 | Monetti | 206/545 |
| 5,500,667 | A | 3/1996 | Schwiebert et al. | 347/102 |
| 5,520,102 | A | 5/1996 | Monetti | 99/483 |
| 5,521,357 | A | 5/1996 | Lock et al. | 219/543 |
| 5,571,435 | A | 11/1996 | Needham | 219/544 |
| 5,572,290 | A | 11/1996 | Ueno et al. | 399/329 |
| 5,581,289 | A | 12/1996 | Firl et al. | 347/104 |
| 5,582,754 | A | 12/1996 | Smith et al. | 219/438 |
| 5,586,214 | A | 12/1996 | Eckman | 392/503 |
| 5,618,065 | A | 4/1997 | Akiyama | 285/21.2 |
| 5,619,240 | A | 4/1997 | Pong et al. | 347/103 |
| 5,625,398 | A | 4/1997 | Milkovits et al. | 347/104 |
| 5,633,668 | A | 5/1997 | Schwiebert et al. | 347/102 |
| 5,691,756 | A | 11/1997 | Rise et al. | 347/102 |
| 5,697,143 | A | 12/1997 | Barfield | 29/611 |
| 5,703,998 | A | 12/1997 | Eckman | 392/340 |
| 5,708,251 | A | 1/1998 | Naveh | 219/121.66 |
| 5,714,738 | A | 2/1998 | Hauschulz et al. | 219/535 |
| 5,779,870 | A | 7/1998 | Seip | 205/77 |
| 5,780,817 | A | 7/1998 | Eckman et al. | 219/458 |
| 5,780,820 | A | 7/1998 | Komyoji et al. | 219/543 |
| 5,781,412 | A | 7/1998 | de Sorgo | 361/704 |
| 5,806,177 | A | 9/1998 | Hosomi et al. | 29/846 |
| 5,811,769 | A | 9/1998 | Schiffmann et al. | 219/762 |
| 5,822,675 | A | 10/1998 | Paquet et al. | 428/561 |
| 5,824,996 | A | 10/1998 | Kochman et al. | 219/529 |
| 5,829,171 | A | 11/1998 | Weber et al. | 36/93 |
| 5,835,679 | A | 11/1998 | Eckman et al. | 392/503 |
| 5,856,650 | A | 1/1999 | Rise et al. | 219/216 |
| 5,902,518 | A | 5/1999 | Khazai et al. | 252/511 |
| 5,930,459 | A | 7/1999 | Eckman | 392/503 |
| 5,940,895 | A | 8/1999 | Wilson et al. | 4/237 |
| 5,947,012 | A | 9/1999 | Ewald et al. | 99/374 |
| 5,954,977 | A | 9/1999 | Miller et al. | 219/201 |
| 5,961,869 | A | 10/1999 | Irgens | 219/549 |
| 6,056,157 | A | 5/2000 | Gehl et al. | 222/94 |
| 6,089,406 | A | 7/2000 | Feldner | 222/103 |
| 6,137,098 | A | 10/2000 | Moseley et al. | 219/727 |
| 6,147,332 | A | 11/2000 | Holmberg et al. | 219/526 |
| 6,147,335 | A | 11/2000 | Von Arx et al. | 219/544 |
| 6,150,635 | A | 11/2000 | Hannon et al. | 219/386 |

OTHER PUBLICATIONS

"Makroblend Polycarbonate Blend, Tedur Polyphenylene Sulfide", *Machine Design: Basics of Design Engineering*, Cleveland, OH, Penton Publishing, Inc., Jun. 1991, pp. 820–821, 863, 866–867.

European Search Report, Jul. 13, 1998.

"At HEI, Engineering is our Middle Name", Heaters Engineering, Inc., Mar. 2, 1995.

"Flexibility and cost Savings with Rope Elements", Heating Engineers, Inc. Aug. 1998.

Desloge Engineering Col, Letter to Lou Steinhauser dated Feb. 19, 1997.

Immersion Heaters Oil and Water, p. 11 ($19_{13}$ )v.

Special Purpose Flange Heaters, p. 58 (19_).

Lakewood Trade Literature entitled "Oil–Filled Radiator Heater" (19_).

Encon Drawing Part Nos. 02–06–480 & 02–06–481 (19_).

Encon Drawing No. 500765 (Jun. 10, 1987).

Vulcan Electric Company Trade Literature entitled "Bushing Immersion Heaters", 1983.

Trade Literature "Euro–Burner Solid Disc Conversion Burners" Energy Convertors, Inc., Dallas, PA 1991.

"Polymers," *Guide to Selecting Engineering Materials*, a special issue of Advanced Materials& Presses, Metals Park, OH, ASM International, 1990, pp. 32–33.

Machine Design, "Basics of Design Engineering" Jun. 1991, pp. 429–432, 551, 882–884.

Machine Design, "Basics of Design Engineering", Jun. 1994, pp. 624–631.

Machine Design, May 18, 2000, 3 pages.

Carvill, Wm. T., "Prepreg Resins", Engineered Materials Handbook, vol. 1, Composites pp. 139–142.

Thermoplastic Polyimide (TPI) Features, RTP Company's 4200 series compounds (4 pages).

World Headquarters, RTP Co, RTP 1300 Series Polyphenylene Sulfide Compounds, 1 page.

World Headquarters, RTP Co, RTP 2100 Series Polyetherimide Compounds, 1 page.

World Headquarters, RTP Co, RTP 3400 Series Liquid Crystal Polymer Compounds, 1 page.

World Headquarters, RTP co, RTP 4200 Series Thermoplastic Polyimide Compounds, 1 page.

A.M. Wittenberg, "Pin Shorting Contact," Western Electric Technical Digest No. 60, Oct. 1980, p. 25.

International Search Report, Aug. 8, 2000.

Kronenberg, K.J., "Magnetic Water Treatment De–Mystified", Green Country Environmental Associates, LLC, pp. 1–8.

* cited by examiner

SMALL DIAMETER LOW WATT DENSITY IMMERSION HEATING ELEMENT

CROSS-REFERENCE TO RELATED APPLICATIONS

The present application is a continuation-in-part of U.S. application Ser. No. 09/756,162, filed on Jan. 8, 2001, and entitled "Flexible Spirally Shaped Heating Element," and is related to U.S. application Ser. No. 09/275,161 filed Mar. 24, 1999, which is a continuation in part of U.S. application Ser. No. 08/767,156 filed on Dec. 16, 1996, now U.S. Pat. No. 5,930,459, issued on Jul. 27, 1999, which in turn is a continuation in part of U.S. application Ser. No. 365,920, filed Dec. 29, 1994, now U.S. Pat. No. 5,586,214, issued on Dec. 17, 1996, which are all hereby incorporated by reference.

This application is also related to U.S. application Ser. No. 09/309,429, filed May 11, 1999, U.S. application Ser. No. 09/369,779, filed Aug. 6, 1999, and U.S. application Ser. No. 09/416,371, filed Oct. 13, 1999, which are also hereby incorporated by reference.

FIELD OF THE INVENTION

This invention relates to electric resistance heating elements, and more particularly, to insulated immersion resistance heating elements having increased service life.

BACKGROUND OF THE INVENTION

Electric resistance heating elements typically contain a polymeric or metal sheath which insulates a Ni—Cr coil or wire disposed axially through the sheath. Such elements are known to experience scale growth in service, which can limit their usefulness.

Good examples of polymeric heating elements include those disclosed in Eckman et al., U.S. Pat. No. 5,586,214, issued Dec. 17, 1996; Lock et al., U.S. Pat. No. 5,521,357, issued May 28, 1996; Welsby et al., U.S. Pat. No. 4,326,121, issued Apr. 20, 1982, and J. W. Welsh, U.S. Pat. No. 3,621,566, issued Nov. 23, 1971, which are all hereby incorporated herein by reference.

Eckman et al. '214 discloses a polymer encapsulated resistance heating element including a resistance heating member encapsulated within an integral layer of an electrically-insulating, thermally-conductive polymeric material. The disclosed heating elements are capable of generating at least about 1,000 watts for heating fluids such as water and gas.

Lock et al. '357 discloses a heater apparatus including a resistive film formed on a substrate. The first and second electrodes are coupled to conductive leads which are electrically connected to the resistive film. The heater also includes an over molded body made of an insulating material, such as a plastic. Lock et al. '357 further disclose that their resistive film can be applied to a substrate, such as a printed circuit board material.

Welsby et al. '121 discloses an electric immersion heater having a planar construction which contains an electrical resistance heating wire shrouded within an integral layer of polymeric material, such as PFA or PTFE, which is wound around end portions of a rectangular frame. The frame and wound resistance wire is then secured in spaced relationship with one or more wrapped frame members, and then further protected by polymeric cover plates which allow for the free flow of fluid through the heater.

J. W. Welsh '566 discloses a single planar resistance member having a dipped coating of thermoplastic material, such as PTFE, nylon or KEL-F, a 3M product. Welsh teaches that his element can be self-cleaning, since the heated wire is free to expand within the insulation, which is flexible.

The problems associated with metal and polymeric sheathed elements in immersed fluids are generally known. These problems are caused by the industry's need for high watt densities. High watt densities can cause high external sheath temperatures which can damage fluid and increase scale build-up, which in turn, can result in high internal heating element temperatures which limit heater life.

The formation of hard lime scale on container walls and heating elements can be traced to the calcium (Ca) or calcium carbonate ($CaCO_3$) content of the water in combination with the scarcity of nucleation centers in ordinary water. When the concentration of the calcium carbonate exceeds its solubility, solidification often begins on the surface of the heating element. Hard lime scale begins with a few starting points on the surface of the element which attach firmly to it and extend crystals which cling to one another in a dendritic crystallization mode. This process continues as further solidification of the mineral occurs, growing layer by layer over each successive formation of dendrites. See Kronenberg, "Magnetic Water Treatment De-mystified", Green Country Environmental Associates, LLC, Jan. 19, 2000, which is hereby incorporated by reference.

Scale produced by residential water heaters operated on hard water at approximately 160° F. consists principally of calcium and calcium carbonate. Differences in water quality at various sites do not generally exert a strong influence on scale composition. Minor metallic constituents, such as magnesium, aluminum and iron, generally comprise less than 3% of the scale composition.

There is a slight improvement in scale resistance associated with polymer sheathed fluid heating elements; however, even polymer-sheathed elements can overheat and fail due to scale build-up, and there remains a need in the heating element industry to minimize element failures due to this phenomena. Some of the challenges associated with improving scale induced overheating in polymer heating elements include (1) the low thermal conductivity of polymeric coatings which generally prevents thick polymer coatings from being used; (2) the need to use a greater surface area to keep the polymer below its heat deflection temperature, while providing for the application's total wattage requirements; (3) the high manufacturing costs associated with larger surface area heaters, and (4) the management of mechanical and creep stresses due to the differences in the coefficient of thermal expansion between metallic and polymeric materials.

SUMMARY OF THE INVENTION

The present invention provides methods of heating larger quantities of liquid within storage containers, such as heating at least one gallon of water in a residential or commercial environment. The storage container is provided with a substantially renewable supply of water, a water inlet and a water outlet. The water has, in solution, a concentration of calcium, calcium carbonate, or both, which is sufficient to form a scale deposit during the heating of the quantity of water. The storage container also includes an electrical resistance immersion heating element, which further includes a resistance heating material disposed within an electrically insulating, substantially water impervious sheath. The immersion heating element has an active element portion having a watt density of no greater than about 60 watts/square inch ("W/in$^2$"), preferably about 10–40 W/in$^2$, but also has an overall wattage rating of at least about 1,000 watts ("W"), preferably about 2,500–4,500 W. In this first method embodiment, the immersion heating element is electrically activated to heat the water above ambient temperature sufficiently to begin the formation of a scale deposit.

The design of the immersion heating elements in this invention substantially reduces the growth of scale in the storage container, on the element surface, or both, which consequently, also increases the life of the immersion heating element. The methods and devices of this invention employ a lower heat flux or watt density to heat fluids, which yields slower scale growth. Since calcium and calcium carbonate have a decreased solubility with increasing water temperature, reducing the watt density of the element tends to slow the growth of scale. While this is not surprising, the small active element volume ("envelope") and total wattage rating requirements of the water heater industry have formerly limited element designs to high watt density, low surface area immersion heater constructions.

While it has recently been believed that higher heat fluxes tend to "pop" off scale, this phenomena does not reliably eliminate scale from all areas of immersion heaters. Discontinuities of heat flux within existing immersion heating elements has been known to cause scale to hang onto cooler areas and grow dendritically from the cooler areas to the heated areas.

Scale crystals will also circulate in the water bath settling on unheated surfaces as well. Scale generation, whether it be on a metal or plastic sheath, generally leads to failure of the immersion heating element, since the resistance heating material will overcompensate to maintain fluid temperature. Element failure can be detected by high leakage current, which is an indication of insulation breakdown, or an element resistance change greater than ten percent, such as when an element breaks during a burnout.

The smaller diameter, low watt density immersion heating elements of this invention have been known to generate element lifetimes greater than 1,000 hours, and even exceeding 2,000 hours at total wattage outputs exceeding 1,000 watts, without element burnout or insulation breakdown. The low watt density, small diameter water heating elements of this invention can be configured to have the same total wattage rating and "envelope" size as higher watt density, larger diameter standard water heaters, yet allow for lower heater surface temperatures, lower heat flux, and slower scale growth.

The lower heater temperatures of the present immersion heaters, generate less total scale in the water tank as well. This is due, in part, to the fact that the maximum temperature that the stored water experiences in the storage container is much lower than water exposed to higher watt density heaters, even though the average bulk water temperatures are about the same. Stated differently, water in direct contact with the hotter sheath of larger diameter, higher watt density heaters, is raised to a higher temperature, and has a greater tendency to form scale, than water in direct contact with the lower temperature immersion heating elements of this invention.

It has been further discovered that, as long as water can circulate around the low watt density, small diameter heaters of this invention, i.e., the water passages are not totally blocked by scale growth, these heating elements become substantially temperature self limiting, due to further scale growth. That is, the maximum wire temperature caused by scale growth can be designed into the heater to prevent insulation breakdown or element burnout. This enables simple polymeric sheathed heating elements, or polymeric wire heaters to be employed without exceeding the melting temperature of the polymeric sheath materials, while simultaneously providing the typical power levels of about 1,000–4,500 watts required by commercial water heaters. Such total wattage ratings can be achieved within the same envelope or element volume as conventional metal sheath heaters of larger diameters, for example, those having U-shaped active element portions with diameters and watt densities of about 0.260 (200 W/in$^2$)–0.315 (80 W/in$^2$) inches. While providing the same envelope and total wattage as large diameter heaters, the elements of this invention provide less of a temperature gradient in the stored water, and at least 10 wt. % less scale mass, preferably at least 50 wt. % less scale mass, and as much as 96 wt. % less scale mass, in the tank.

The "self-limiting" temperature feature of small diameter, low watt density heaters applies equally to metal sheath-granular ceramic insulation constructions and polymer-coated wire constructions alike, although scale growth tends to collect faster and bind tighter on metal sheathing.

In conclusion, the use of a small diameter, low watt density heater is a practical solution to scale build up and shortened element life in water heating applications. The present invention is best utilized when water circulation is maintained around the active element portion as scale grows. The immersion heaters of this invention can fit within the required envelope of standard water heater element designs, which is generally limited by the 1–1.5 inch standard opening of residential hot water heaters, and the width of the standard storage containers. Typically, the envelope is approximately 1.188 in. in diameter and about 6–15 inches in length, for a total envelope of approximately 5–50 in$^3$, preferably less than about 30 in$^3$.

In further embodiments of this invention, a combination of a storage container and an immersion heating element is provided. The storage container is provided with a substantially renewable supply of water which contains calcium, calcium carbonate or both in a concentration sufficient to form a scale deposit during the heating of the water. The electrical resistance immersion heating element is mounted through the wall of the storage container and includes a resistance heating material disposed within an electrically insulating, substantially water impervious sheath to form an active element portion. The active element portion has a cross-sectional dimension of no greater than about 0.25 inches, preferably less than 0.125 in, and most preferably, about 0.025–0.069 in., and has a watt density of no greater than about 60 W/in$^2$, preferably about 10–40 W/in$^2$, and most preferably about 20–35 W/in$^2$, while providing a total wattage rating of at least about 2500–4500 watts.

The elements of this invention can be tubular or polymer coated wire designs, or alternatively, can be disposed within, or on, the wall of the storage tank itself. One such design includes as molding a Ni—Cr wire into a PPS tank. Such can be accomplished by blow molding the storage tank into two separate steps, with an intermediate wire wrapping step, for example.

A BRIEF DESCRIPTION OF THE DRAWINGS

The accompanying drawings illustrate preferred embodiments of the invention, as well as other information pertinent to the disclosure, in which.

DETAILED DESCRIPTION OF THE INVENTION

Figure 1:
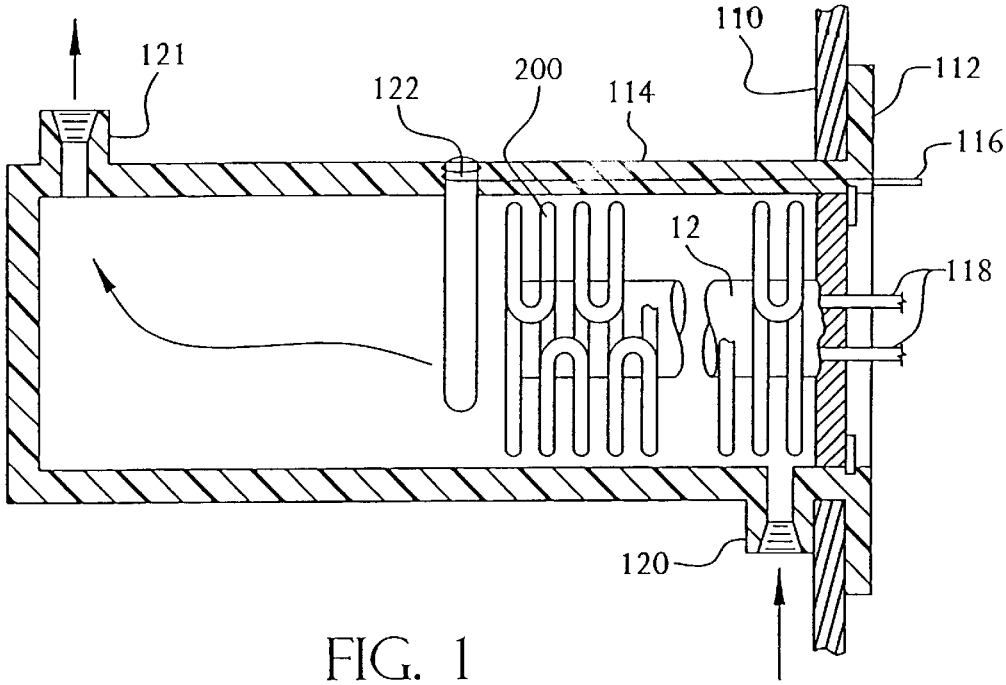
FIG. 1 is a front, partial cross-sectional view of a preferred heating element embodiment of this invention, including an optional element container.

The present invention provides polymeric heating elements useful in all sorts of heating environments, especially those for heating liquids in industrial and commercial applications, including pools and spas, food service (including food warmers, food dispensers and cooking surfaces and devices), water heaters, plating solution heaters, oil-containing space heaters, and heated medical devices. The disclosed heating elements can serve as replaceable heating elements for hot water service, including hot water storage capacities of 1–5,000 gallons, point of use hot water heaters, and retrofit applications. They can be used for instant-on type heaters, and can be provided with element container or storage container. As used herein, the following terms are defined:

"Additives" means any substance added to another substance, usually to improve properties, such as, plasticizers, initiators, light stabilizers, fiber or mineral reinforcements, fillers and flame retardants.

"Composite Material" means any combination of two or more materials (reinforcing elements, fillers, and composite matrix binder), differing in form or composition on a macro scale. The constituents retain their identities: that is, they do not dissolve or merge completely into one another although they can act in concert. Normally, the components can be physically identified and exhibit an interface between one another.

"Spiral" means one or more looped or continuous forms of any geometric shape, including rectangular and circular, moving around a fixed point or axis; multiple spirals need not be centered on the same point or axis; a spiral can include, for example, a coil of wire located substantially in a single plane, a springlike structure having a longitudinal axis, or a series of coils connected by "u" shaped bends.

"Spirally" means shaped like a spiral.

"Coefficient of Thermal Conductivity" means the property of a material to conduct thermal energy (also known as "K-value"); it is typically measured in w/m–° C.

"Active Element Volume" or "Envelope" means the volume, as defined by the element's outer periphery or outermost external surface, that an immersion heating element occupies, typically about 5–50 $in^3$, for commercial water heating elements. For example, the envelope of a coil is the volume defined by a cylinder having a diameter coextensive with the outer diameter of the coil, even though the volume of the material that makes up te coil itself is much less.

"Flux" means the heat flow (W or watts) per unit area ($in^2$ or $m^2$) of a heating element; it is also referred to as the Heat Flux or Watt Density of a heating element.

"Scale" means the deposits of Ca or $CaCO_3$, along with trace amounts of other minerals and oxides, formed, usually, in layers, on surfaces exposed to water storage (especially heated water).

"Effective Relative Heated Surface Area" ($in^2/in^3$) means the surface area of the Active Element Portion (herein defined as the "Effective Surface Area", $in^2$), divided by the Active Element Volume or Envelope.

"Active Element Portion" means the portion of the element exposed to the solid, liquid or gas to be heated.

"Integral Composite Structure" means a composite structure in which several structural elements, which would conventionally be assembled together by mechanical fasteners after separate fabrication, are instead, adhered together, melt bonded, or laid up and cured, to form a single, complex, continuous structure. All or some of the assembly may be co-cured, or joined by heat, pressure or adhesive.

"Reinforced Plastic" means molded, formed, filament-wound, tape-wrapped, or shaped plastic parts consisting of resins to which reinforcing fibers, mats, fabrics, mineral reinforcements, fillers, and other ingredients (referred to as "Reinforcements") have been added before the forming operation to provide some strength properties greatly superior to those of the base resin.

"Self-Limiting" means that the immersion heater becomes generally resistant to further increases in temperature with further scale growth.

"Tubular Heating Element" means a resistance heating element having a resistance heating wire surrounded by a ceramic insulator and shielded within a plastic, steel and/or copper-based tubular sleeve, as described in, for example, U.S. Pat. No. 4,152,578, issued May 1, 1979, and hereby incorporated by reference.

Other terms will be defined in the context of the following specification.

Spiral Element Construction

With reference to the drawings, and in particular to FIGS. 1–4 thereof, there is shown a preferred flexible spirally shaped heating element 200 including a resistance heating material 18 having an electrically insulating coating 16 thereon. The coated resistance heating material 10 is desirably shaped into a configuration which allows substantial expansion during heating of the element. More preferably, this substantial expansion is created through a series of connected, spirally shaped forms such as those disclosed in the spirally shaped heating elements 100, 200 and 300. Due to their length and non-constricting nature, such spirally shaped forms have the ability to expand and contract at a rate which is greater than a shorter, confined flat sinus member, such as that described by Welsh '566, or a wire which is fixed on a stamped metal plate, as shown by Welsby et al. '121. The preferred flexible spirally shaped heating elements 100 and 200 of this invention preferably are self-supporting, but can be wound around a central axis 14 of a core 12 and terminate in a pair of power leads 118 or 11. The core 12 desirably is of an insulating material, such as wood, ceramic, glass or polymer, although it can be of metallic construction if made part of the resistance heating function, or if the resistance heating material is coated in a polymer, glass or ceramic such as described in the preferred embodiments of this invention.

The power leads 11 and 118 are desirably terminated in a conventional manner such as by compression fittings, terminal end pieces or soldering. Plastic-insulated cold pins can also be employed.

The preferred heating element construction of this invention can be disposed within an element container 114, preferably including a molded polymeric material such as, polyethylene, polystyrene, PPS or polycarbonate. The element container 114 preferably allows enough room for the spirally shaped heating element 100, 200 or 300 to expand without constriction. The element also can optionally include a temperature or current sensing device 122, such as a circuit breaker, thermostat, RTD, solid state temperature sensor, or thermocouple. The temperature or current sensing device 122 can be disposed within the insulating coating 16, in the wall of the element container 114, in the core 12, or disposed in close proximity to the heating element 100, 200 or 300.

When an element container 114 is employed, it is desirable that the container have one or more openings, such as liquid inlet and outlets, 120 and 121. This permits the cold water to enter in the liquid inlet 120, and hot water to exit the liquid outlet 121. Alternatively, such a device can act independently of a water storage tank, as in for example, a point of use hot water dispenser or oil preheater, whereby fluid pipes are connected to the liquid inlets and outlets 120 and 121.

Figure 3:
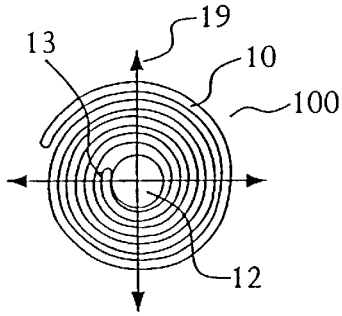
FIG. 3 is a side, elevational view of the spirally shaped heating element of FIG. 2.
Figure 5:
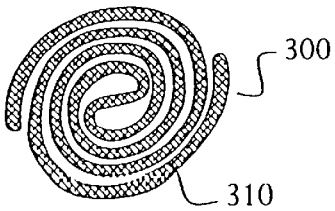
FIG. 5 is a side, elevational view of an alternative shaped heating element without a central core.
Figure 4:
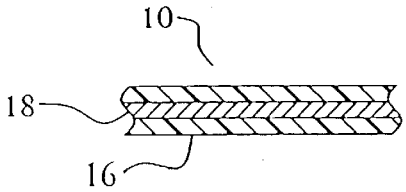
FIG. 4 is a partial, cross-sectional view, taken through line 4—4 of FIG. 2, showing a preferred construction of the heating element.

As shown in FIG. 3, the spirally shaped heating element of this invention can include a pair of axes of thermal expansion 17 and 19. Desirably, the spirally shaped heating element 100, 200 or 300 can expand at least about 1%, and more desirably, about 5–100% along such axes 17–19, as it unwinds and opens, to relieve mechanical stresses and improve descaling.

As shown in the preferred embodiments, FIGS. 2–5, the spirally shaped heating elements 100, 200 and 300 of this invention can include multiple connected spirals of coated resistance material 10 or 310 arranged along a common center line.

Figure 2:
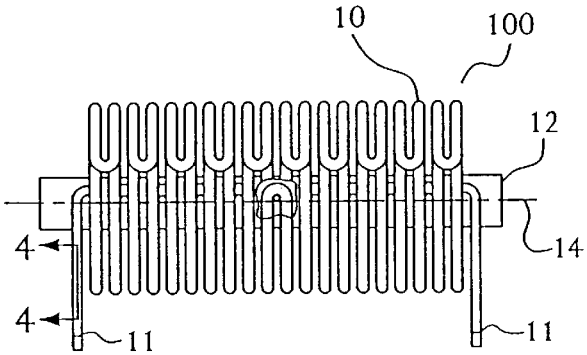
FIG. 2 is a top, plan view, with a partial break-away view, of an alternative spirally shaped heating element of this invention.

In the element 100 of FIGS. 2 and 3, the first pair of spirals is connected by a 180° turn of wire connecting the outer or inner ends of the first spiral. The third consecutive spiral is connected to the second spiral with a 180° turn of wire at the opposite end of the second spiral from the connection formed between the first and second spiral. This pattern is continued for the remaining spirals, alternating the 180° turn of wire connections between inter and outer ends of each spiral. These 180° turn connections are formed during the winding of the element which can be accomplished on a fixture having a plurality of pins for enabling the coated resistance heating material 10 to be wound and plastically deformed into a set spiral shape. The unconnected ends of the first and last spiral are connected to electrical leads (not shown). The individual spirals can be oval, rectangular or oddly shaped and, depending on the rigidity of the resistance wire or ribbon employed, may be supported without a core 12, as in element 300 of FIG. 5, and with or without an inner 180° turn. Optionally, the inner 180° turn can be fixed to the rod 12 by a pin 13 as shown in FIG. 3, or alternatively, by adhesive bond, weld, ultrasonic or solder joint.

The resistance heating material 18 may be a metal alloy or conductive coating or polymer, and may have a positive temperature coefficient of resistance for limiting heat or power in the case of overheating. The resistance heating material 18 may or may not be insulated within an insulating coating 16, depending upon the requirements for electrical insulation and the medium used or required application. The resistance heating material 18 of this invention may have a round, flat or other cross-sectional shape and may be solid or in powder form, and may be made of more than one alloy with different thermal expansion rates to increase the expansion or contraction of the spirally shaped heating elements 100 or 200 of this invention, with resulting improvements in the shedding of scale. Such bimetallic wire, having a longitudinal seam, is often used in residential thermostats, for example.

The spirally shaped heating elements 100, 200 or 300 of this invention may be formed with a wire or ribbon which is precoated with a polymer, thermoplastic or thermosetting resin before winding, or the wire may be wound with uncoated wire or ribbon, and then coated with a polymer by spray coating, dip coating, electrical coating, fluidized bed coating, electrostatic spraying, etc. The disclosed cores 12 may form a portion of the heating element or may be used merely to form its shape prior to disposing the core 12.

The spirally shaped heating elements of this invention, when used for residential water heating applications, are preferably designed to fit within a 1–1.5 in. diameter standard tank opening of typical hot water heaters. They are designed to have an "effective relative heated surface area" of about 5–60 $in^2/in^3$, desirably about 10–30 $in^2/in^3$.

The flexible, spiral shaped heating elements 100, 200 and 300 of this invention preferably include a resistance metal in ribbon or wire form and about 30–10 gauge sizes, preferably about 16–20 gauge, with coating thickness of about 0.001–0.020 inches, preferably about 0.005–0.012 inches. Desirable element examples have used 20 gauge Ni—Cr wire having a PFA coating of approximately 0.009 inches, resulting in an effective relative heated surface area of approximately 28 $in^2/in^3$, and sized to fit within a 1–1.5 inch diameter opening of a typical water heater.

The preferred coated or uncoated resistance wire or ribbon should be stiff enough to support itself, either alone or on a supporting carrier or core 12. The core 12 of this invention can be rod-like, rectangular, or contain a series of supporting rods or pins, such as a locating pin 13. A carrier, not illustrated, would be a metal or polymer bonded to, coextruded with, or coated over, the resistance heating material 18. The stiffness of the electrical resistance ribbon or wire can be achieved by gauge size, work hardening or by the selection of alloy combinations or conductive or non-conductive polymeric materials which are desirably self-supporting. This allows the spirally shaped heating element 100, 200 or 300 to provide differences in the radius of curvature during heating, and a much greater effective relative heated surface area than conventional tubular heaters (about 5 $in^2/in^3$) or cartridge heaters (about 4 $in^2/in^3$).

In further embodiments of this invention, the spirally shaped heating element 100, 200 or 300 can be constructed in a narrow diameter of approximately 1–6 in. which is thereafter expandable to about 2–30 inches, for example, after it is introduced through the side wall of a tank or container. This can be accomplished by retaining the spirally shaped heating element within a water soluble coating, band or adhesive, such as starch or cellulose, which is dissolved upon heating or by direct contact by a liquid, such as water. Alternatively, a low melting temperature coating, band, or adhesive, can be used, such as a 0.005–0.010 application of polyethylene or wax, for example.

Upon replacement of such spirally shaped heating elements, the flange 12, and any associated fasteners (not shown), can be removed with the coated or uncoated resistance heating material 10 being pulled through the 1–6 in. standard diameter opening. In the instance where a element container 114 is not employed, the spirally shaped heating element 100 can be removed through small openings by bending and deforming the individual spirals. Damage to the heating element at this point is not of any consequence, since the element will be discarded anyway.

Small Diameter, Low Watt Density Immersion Heating Elements

This invention also provides small diameter, low watt density immersion heating elements which can be spirally shaped, but do not necessarily rely upon thermal expansion and contraction for scale removal. Applicants have determined through experimentation and extrapolation of data from known heat transfer formula, that reducing the watt density or heat flux of the immersion heating element below about 60 watts per square inch, more preferably about 10–40 watts per square inch and ideally about 20–35 watts per square inch dramatically improves heater life and almost eliminates insulation breakdown and element burnout due to increased scale thickness in plastic sheath, metal sheath and tubular embodiments. Such watt densities can be achieved with cross-sectional dimensions for the active element portion of the heater element under 0.025 inches, more preferably less than 0.125 inches, and most preferably about 0.025–0.069 inches, as measured at the sheath's outer diameter (OD), for example. Such design configurations can be achieved with conventional metal sheathed heaters, tubular heaters, or with plastic sheathed heaters, to name a few.

With reference to FIGS. 6–11, a preferred electric resistance immersion heating element 200 is provided. Immersion heating element 200 is a dual coil design, including an outer coil 210 and an inner coil 220. In order to achieve an overall wattage rating of about 4500 watts, each of these coils 210 and 220 can be selected to generate about 1000–3000 total watts. Several or more overlapping coils of this type can be used to provide selective wattage ratings for multiple purposes, such as the initial heating of large quantities of water, followed by maintenance heating of said water to achieve a steady state temperature. Alternatively, a single wire may be used which is connected at the terminal end of the immersion heating element 200. The immersion heating element 200 can be bolted or affixed to a wall 205 of a storage container. In the disclosed embodiment, a plastic end plug 305 having threads 306 is employed to create a water-tight seal at the 1 3/16" opening through the storage container wall 205. Through the plastic end plug 305, electrical connections can be made to a source of electrical power.

The heater wire 226 or material can include typical electrical resistance heating materials disclosed herein, and the polymeric sheath 228 can include most thermoset and thermoplastic materials, also disclosed herein. In a detailed preferred embodiment of this invention, a 16 gauge Chromel P (NiCr) wire is coated or co-extruded with a 0.009 inch PFA, fluorocarbon resin layer, as shown disclosed in FIG. 10.

An examination of coupon scale test results indicated a correlation between scale formation and material choice. Smooth textured polymers, such as polyethylene, were most desirable for scale resistance. Untreated exposed glass fibers assisted in bonding to scale, and discouraged against most uncoated, glass-filled polymers. Silane-treated glass fibers, however, had less attraction to scale and could be used. Similarly, untreated calcium carbonate should not be used as a filler in polymer coatings used on immersion heaters. Calcium carbonate fillers could trigger additional scale formation if exposed to the surface of the polymeric material. Another material which showed promise in scale reduction was a Visgard™ coated polycarbonate. Without being committed to any particular mechanism, it may be that certain hydrophilic coatings permit water molecules to tightly bond to the sheath surface that they create a barrier to scale growth. It appears, however, that both highly hydrophobic and highly hydrophilic surfaces can resist scale, but in the case of hydrophilic surfaces, evidence indicates that only the most extremely hydrophilic examples will prevent scale bonding.

The results of scaling experiments also indicated a correlation with surface roughness and surface energy. Smooth surfaces were less likely to attract scale growth than rough surfaces were.

Relating further to the immersion heating element 200, there is shown a pair of bifiler wind closed, 11 inch long (stretched to provide spacing of about 0.1–0.18 inches). In this embodiment, the outer coil 210 has an outer dimension of 1.188 inches and the inner coil 220 has an outer diameter of 0.849 inches. The inner coil 220 was assembled on a pair of 0.100 diameter rods 217, mounted in end plates 211 and 213, by off-setting every other turn. The outer coil 210 was then assembled on two additional 0.100 diameter rods 216, also mounted in said end plates 211 and 213. The inner and outer coils 210 and 220 are electrically wired in series. The multiple coil arrangement is supported axially by a core rod 212 made of previously disclosed core rod materials, and is more preferably made of a 5/16 inch diameter steel, or plastic rod, covered with fluorocarbon-based heat shrink tubing.

Figure 7:
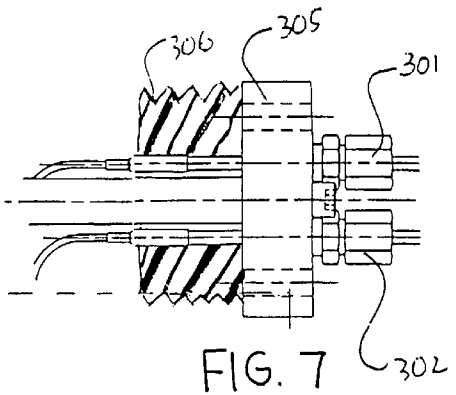
FIG. 7 is a top partial cross-sectional view of the end plug region of the immersion heating element of FIG. 6.
Figure 8:
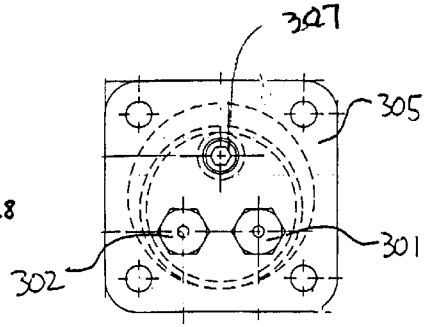
FIG. 8 is a right side elevational view of the immersion heating element of FIG. 6.
Figure 10:
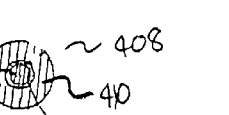
FIG. 10 is a cross-sectional view of a 0.069 inch polymeric coated wire element of the present invention.

As shown in FIGS. 7 and 8, the terminal ends of the coils 210 and 220 are disposed through compression fittings 301 and 302 in the plastic end plug 305. The core rod 212 can be supported with a core rod retention screw 307 or, alternatively, molded together with the plastic end plug 305.

Figure 11:
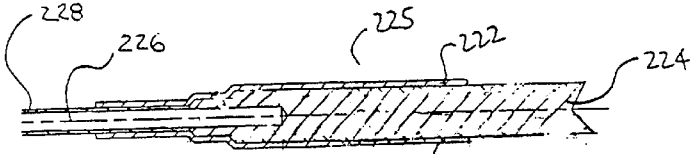
FIG. 11 is an enlarged, front cross-sectional view of the cold pin region of the immersion heating element of FIG. 6.
Figure 6:
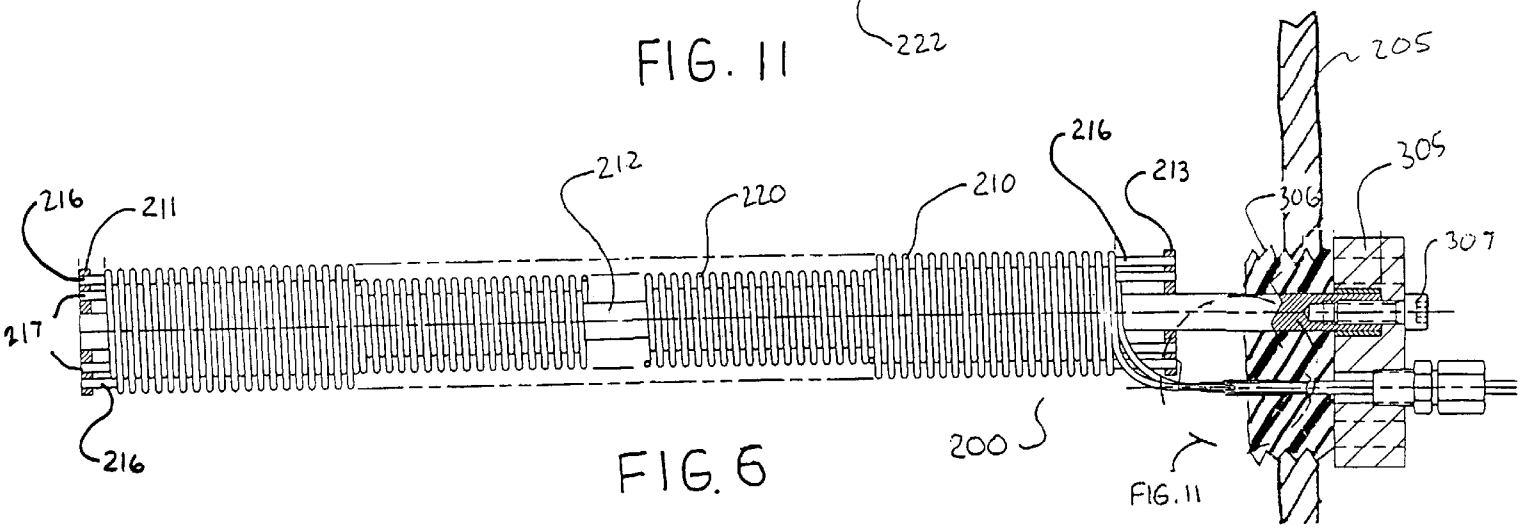
FIG. 6 is a front, plan view, and partial cross-sectional view, of an alternative immersion heating element of this invention having dual coiled active element portions and an threaded plastic end plug.

As shown in FIG. 11, the inner and outer coils 220 and 221 can be terminated with a typical cold pin arrangement. In the preferred embodiment, the 16 gauge Chromel P wire is fitted into a drilled opening of a 10 gauge copper cold pin 224. The cold pin 224 is preferably insulated by a fluorocarbon-based heat shrink tubing 222. The cold pin assembly 225 can be finished by stripping a portion of the polymer sheath 228 from the end of the resistance heating wire 226 and soldering the resistance heating wire 226 in the recess of the copper cold pin 224. The "overlap" of the heat shrink tubing 222 and polymer sheath 228 should be less than, or equal to, about 0.25 inches. The cold pin 224 should have a diameter of at least twice the diameter of the resistance heating wire 226 for acting as a "heat sink", drawing heat away from the resistance wire, especially at the "overlap" region.

General Element Materials

The preferred electrical resistance heating material 18, or heater wire 226, contains a material which generates heat when subjected to electric current. It can be coated by an insulating coating 16, such as polymeric sheath 228, or left uncoated. Such materials are usually inefficient conductors of electricity since their generation of resistance heat is usually the result of high impedance. The preferred electrical resistance material can be fashioned into at least 2–1000 spirals, in one or multiple coils. The resistance heating material can take the form of a wire, braid, mesh, ribbon, foil, film or printed circuit, such as a photolithographic film, electrodeposition, tape, or one of a number of powdered conducting or semi-conducting metals, polymers, graphite, or carbon, or one of these materials deposited onto a spiral carrier surface, which could be a polymer, metal or other fluid-resistant surface. Conductive inks can be deposited, for example, by an ink jet printer onto a flexible substrate of another material, such as plastic. Preferably, if a wire or ribbon is used, the resistance heating wire 18 or ribbon contains a Ni—Cr alloy, although certain copper, steel, and stainless-steel alloys, or even conductive and semi-conductive polymers can be used. Additionally, shape memory alloys, such as Nitinol® (Ni—Ti alloy) and Cu—Be alloys, can be used for carriers for the spirals.

The resistance heating wire 226 can be provided in separate parallel paths, for example, a pair of wires or ribbons, separated by an insulating layer, such as polymer, or in separate layers of different resistance materials or lengths of the same material, to provide multiple wattage ratings. Whatever material is selected, it should be electrically conductive, and heat resistant.

Since it is desirable for the electrical resistance material 18 to be in a spiral form that is capable of expanding and contracting when heated or energized, a minimum gauge of 30 g is desirable, preferably about 30–10 g and more preferably about 20–16 g, not including the insulating coating 16 or polymeric sheath 228. In practice, it is expected that the electrical resistance material 18, in the preferred wire or ribbon form, be wound into at least one curved form or continuously bending line, such as a spiral, which has at least one free end or portion which can expand or contract at least 0.5–5 mm, and preferably at least about 5–10% of its original outer dimension. In the preferred embodiment, this free end portion is a 180° looped end, shown in FIGS. 1 and 2. Alternatively, said expansion and contraction should be sufficient to assist in descaling some of the mineral deposits which are known to build up onto electrical resistance heating elements in liquid heating applications, especially in hot water service. Such mineral deposits can include, for example, calcium, calcium-carbonate, iron oxide, and other deposits which are known to build up in layers over time, requiring a higher heater temperature to transfer the same wattage to the water, which eventually results in element failure.

The insulating coating 16, if employed, is preferably polymeric, like polymeric sheath 228, but can alternatively contain any heat resistant, thermally conductive and preferably non-electrically conductive material, such as ceramics, clays, glasses, and semi-conductive materials, such as gallium arsenide or silicon. Additionally, cast, plated, sputter-coated, or wrought metals, such as aluminum, copper, brass, zinc and tin, or combinations thereof, could be used, if the resistance wire or material is insulated in a coating such as glass, ceramic, or high temperature polymer, or if electrical shorting is not an issue, such as in connection with the heating of dry materials or non-flammable gases, such as air.

The preferred insulating coating 16 or sheath 228 of this invention is made from a high-temperature polymeric resin including a melting or degradation temperature of greater than 93° C. (200° F.). High temperature polymers known to resist deformation and melting at operating temperatures of about 75–85° C. are particularly useful for this purpose. Both thermoplastics and thermosetting polymers can be used. Preferred thermoplastic materials include, for example: fluorocarbons (such as PTFE, ETFE, PFA, FEP, CTFE, ECTFE, PVDF, PVF, and copolymers thereof), polypropylene, nylon, polycarbonate, polyetherimide, polyether sulfone, polyaryl-sulfones, polyimides, and polyetheretherkeytones, polyphenylene sulfides, polyether sulfones, and mixtures and co-polymers of these thermoplastics. Preferred thermosetting polymers include epoxies, phenolics, and silicones. Liquid-crystal polymers can also be employed for improving high-temperature use, such as for example, RTP 3400-350MG liquid crystal polymer from RTP Company, Winona, Minn. Also useful for the purposes of this invention are bulk molding compounds ("BMCs"), prepregs, or sheet molding compounds ("SMCs") of epoxy reinforced with about 5–80 wt % glass fiber. A variety of commercial epoxies are available which are based on phenol, bisphenol, aromatic diacids, aromatic polyamines and others, for example, Lytex 930, available from Quantum Composites, Midland, Mich. Conductive plastics, such as RTP 1399X86590B conductive PPS thermoplastic, could also be used, with or without a further resistance heating material, such as those described above. Applicant has found a thin layer, about 0.005–0.012 in of PFA to be most desirable for this invention. Tests have shown that the thin polymer coatings and high Effective Relative Heated Surface Area of these elements arrests scale development, providing greater element life.

It is further understood that, although thermoplastic resins are desirable for the purposes of this invention, because they are generally heat-flowable, some thermoplastics, notably polytetraflouroethylene (PTFE) and ultra high-molecular-weight polyethylene (UHMWPE) do not flow under heat alone. Also, many thermoplastics are capable of flowing without heat, under mechanical pressure only. On the other hand, thermosetting polymers are usually heat-settable, yet many thermosetting plastics such as silicone, epoxy and polyester, can be set without being heated. Another thermosetting material, phenolic, must first be made to flow under heat, like a thermoplastic, before it can be heat-set. For the most part, however, thermosetts are known to cross-link and thermoplastics do not.

As stated above, the insulating coating 16 or sheath 228 of this invention preferably also includes reinforcing fibers, such as glass, carbon, aramid (Kevlar®), steel, boron, silicon carbide, polyethylene, polyamide, or graphite fibers. Glass reinforcement can further improve the maximum service temperature of the insulating coating 16 for no-load applications by about 50° F. The fibers can be disposed throughout the polymeric material in amounts of about 5–75 wt % prior to, or after coating or forming the final heating elements 100 or 200, and can be provided in single filament, multi-filament thread, yam, roving, non-woven or woven fabric. Porous substrates, discussed further below, such as ceramic and glass wafers can also be used with good effect.

In addition to reinforcing fibers, the insulating coating 16 or sheath 228 may contain thermally conducting, preferably non-electrically conducting, additives in amounts of about 5–80 wt %. The thermally-conducting additives desirably include ceramic powder such as, for example, $Al_2O_3$, MgO, $ZrO_2$, Boron nitride, silicon nitride, $Y_2O_3$, SiC, $SiO_2$, $TiO_2$, etc., or a thermoplastic or thermosetting polymer which is more thermally conductive than the polymer matrix of the insulating coating 16. For example, small amounts of liquid-crystal polymer or polyphenylene sulfide particles can be added to a less expensive base polymer such as epoxy or polyvinyl chloride, to improve thermal conductivity. Alternatively copolymers, alloys, blends, and interpenetrating polymer networks (IPNs) could be employed for providing improved thermal conductivity, better resistance to heat cycles and creep.

EXAMPLES

Figure 9:
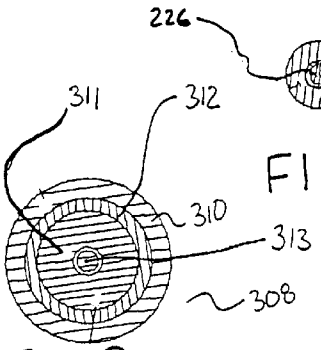
FIG. 9 is a cross-sectional view of a 0.315 inch diameter metal sheathed tubular heater.
Figure 12:
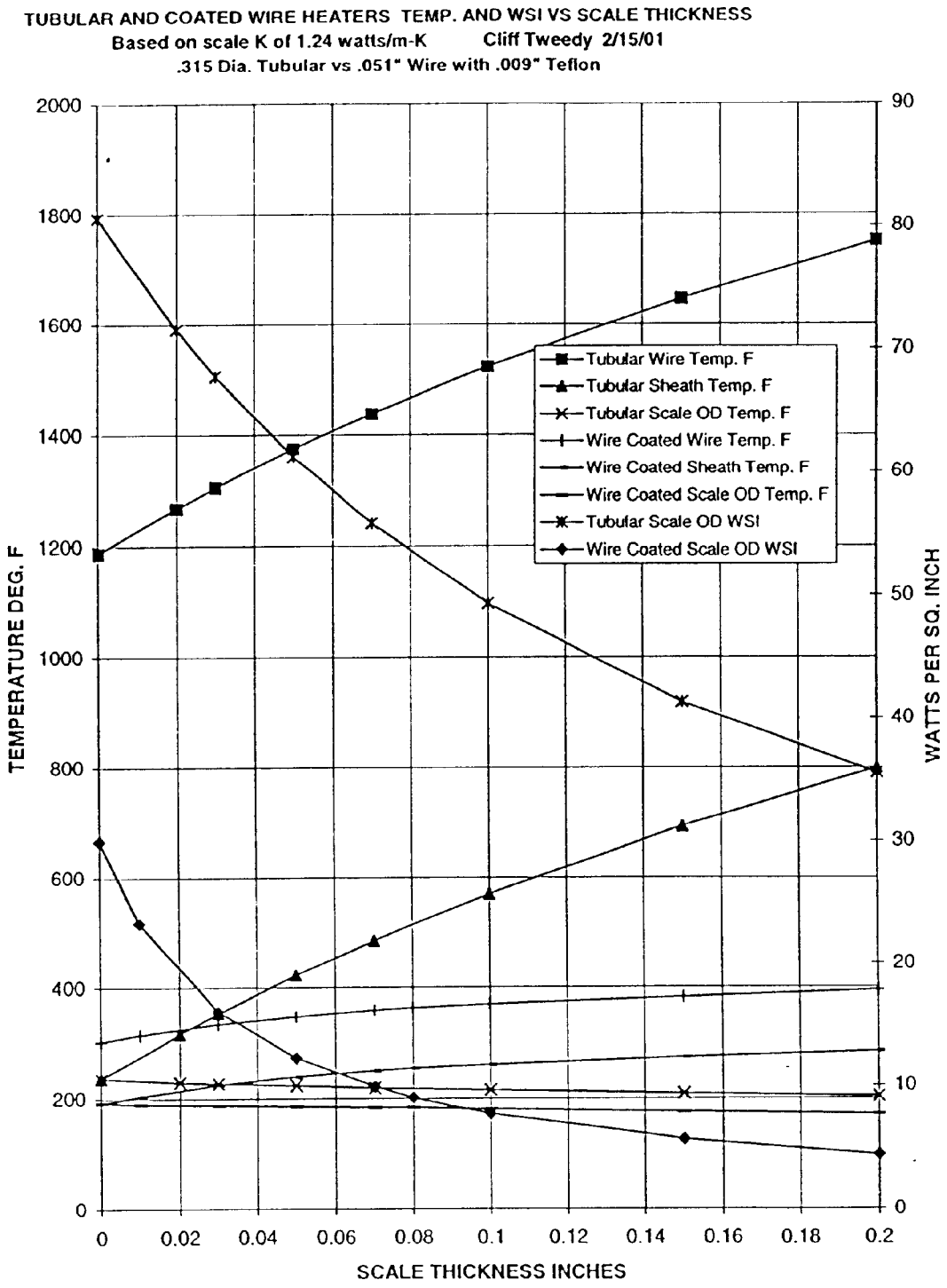
FIG. 12 is a graphical depiction showing the relationship of temperature, scale thickness and watt density for a 0.315 diameter metal sheathed tubular element and a 0.069 polymer coated wire immersion heater.

FIG. 12 graphically represents the measured temperatures along the wire, sheath and scale in relation to scale outer diameter ("O.D.", inches) and watt density (W/in$^2$) for a 0.315" O.D., 80.67 W/in$^2$ tubular heater 308, shown in FIG. 9. The tubular heater had a NiCr coiled wire core 313, granular MgO insulation 311, and a metal sheath 312. Scale 310 developed quickly on its surface. Also tested was a 0.069" O.D., 30 W/in$^2$ fluorocarbon coated 0.051" dia. Chromel P (NiCr) wire heater 408, shown in FIG. 10, which also developed scale 410. Both heaters ran at the normal power density for a 4,500 watt heater.

FIG. 12 was plotted from the following data:

0.315 dia. tubular:

| Tubular Scale Thickness (in.) | Tubular Wire Temp. (° F.) | Tubular Sheath Temp. (° F.) | Tubular Scale OD Temp. (° F.) | Tubular Scale OD (W/in$^2$) |
|---|---|---|---|---|
| 0 | 1187 | 235 | 235 | 80.67 |
| 0.02 | 1268 | 315 | 228 | 71.57 |
| 0.03 | 1305 | 353 | 226 | 67.75 |
| 0.05 | 1375 | 422 | 222 | 61.22 |
| 0.07 | 1438 | 485 | 218 | 55.84 |
| 0.1 | 1523 | 570 | 214 | 49.34 |
| 0.15 | 1646 | 693 | 208 | 41.31 |
| 0.2 | 1751 | 798 | 203 | 35.54 |

Coated wire .051 in. dia. with .009 in. fluorocarbon coating:

| Wire Coated Scale Thickness (in.) | Wire Coated Wire Temp. (° F.) | Wire Coated Sheath Temp. (° F.) | Wire Coated Scale OD Temp. (° F.) | Wire Coated Scale OD (W/in$^2$) |
|---|---|---|---|---|
| 0 | 302 | 192 | 192 | 30 |
| 0.01 | 314 | 204 | 189 | 23.26 |
| 0.03 | 333 | 224 | 187 | 16.05 |
| 0.05 | 347 | 238 | 185 | 12.25 |
| 0.07 | 359 | 249 | 183.22 | 9.9 |
| 0.08 | 363 | 254 | 183 | 9.04 |

From the data and recognized thermal relationships the following is known:

| | .315 dia. tubular | .069 dia. coated wire |
|---|---|---|
| Sheath temperature at 0.00" scale | 235° F. | 192° F. |
| Scale OD temperature at 0.05" scale | 222° F. | 185° F. |
| Sheath temperature at 0.05" scale | 422° F. | 236° F. |
| % Scale OD W/in$^2$ reduction with .05" scale | 24% | 59% |
| % Sheath temperature increase | 80% | 24% |

Conclusions and Summary

Several important observations can be acquired from these Examples. First, the scale is not impervious to water and therefore some of the water comes into contact with the very high sheath temperatures of the 0.315" dia. tubular heater as the scale grows. This tends to accelerate scale growth. Second, the sheath temperature of the small diameter (0.069") coated wire heater starts at a lower value and increases, due to scale growth, at a slower rate than the 0.315 dia. tubular heater. Third, the small diameter (0.069") wire temperature becomes asymptotic to approximately 400° F. as the scale thickness grew. This is the maximum temperature this heater insulation material will experience as long as the water can circulate freely around the scale OD.

The low watt density of a small diameter coated wire heating element when configured for the same total wattage and envelope size as higher watt density, larger diameter tubular heater, allows for lower heater temperatures and slower scale growth. The lower heater temperatures of the low watt density, small diameter coated wire heater, generated less total mass of scale in the water tank. This is due to the fact that the maximum temperature any portion of the water experiences is lower for the coated wire than for the higher watt density heater, even though the average bulk water temperatures are the same. This phenomena was observed in clear storage tanks, by examining the water light refraction due to density changes in water as the temperature increased.

As long as water can circulate around heater, the smaller diameter coated wire heater was self limiting in temperature increases, due to scale growth. This temperature limit, observed to be about 400° F., is within the polymer softening point limits for typical power levels required by water heaters. The larger diameter tubular heater (0.315" OD) shows this same limiting feature, but the temperatures become excessive (above 1800° F.) with scale growth. Accordingly, heaters with typical metal constructions of 0.260–0.315 in. OD tend to fail due to scale build-up.

This limiting feature of small diameter heaters would apply for metal tubular constructions with diameters less than about 0.25 in., as well as to polymer sheath constructions of the same OD, although the scale would collect faster on the metals. Heaters with a large radius of curvature, i.e., 1" and greater, do not show any practical temperature limiting due to scale growth, and a flat surface (infinite radius of curvature) has no self-limiting capability. The use of a low watt density, small diameter polymer or metal sheath or tubular heater is a practical solution to water heating with scaling tendencies.

In view of the foregoing, it can be realized that this invention provides electrical resistance immersion heating elements which provide an improved resistance to scale growth and longer service life. The preferred elements provide a small diameter, low watt density alternative to high watt density 0.260–0.315 in diameter tubular elements. This invention creates low scaling heaters which (1) do not inhibit water circulation, even during scale growth, (2) fit within the required envelope for commercial water heaters and (3) provide the same total watt ratings as larger tubular elements. The heating elements of this invention can be used for hot water storage applications, food service and fuel and oil heating applications, consumer devices such as hair dryers, curling irons etc., and in many industrial applications. Although various embodiments have been illustrated, this was for the purpose of describing, but not limiting the invention. Various modifications which will become apparent to one skilled in the art, are within the scope of this invention described in the attached claims.

We claim:

1. A method of heating a quantity of water within a storage container, comprising:

providing a storage container having a storage capacity of at least one gallon, said storage container containing a substantially renewable supply of water, said storage container having a water inlet and a water outlet;

said water containing calcium, calcium carbonate, or both, in solution in a sufficient concentration to form a scale deposit during the heating of said quantity of water;

said storage container also including an electrical resistance immersion heating element disposed therein;

said immersion heating element including a resistance heating material disposed within an electrically insulating, substantially water impervious sheath;

self limiting an upper temperature of said immersion heating element due to scale deposit induced overheating thereof, by said resistance heating material having, a watt density of no greater than about 60 W/in$^2$, and an overall wattage rating of at least about 1000 W;

said immersion heating element having a capability of fitting within an envelope of no greater than about 50 in$^3$; and electrically activating said immersion heating element to produce power for heating said water above ambient temperature, and self-limiting the upper temperature of said resistance heating material as induced by formation of said scale deposit.

2. The method of claim 1 wherein said resistance heating material comprises a spiral or coil which permits the free circulation of water over its surface.

3. The method of claim 1 wherein said resistance heating material has a diameter of less than about 0.25 inches.

4. The method of claim 1 wherein said electrically activating step activates said immersion heating element to produce about 2500–4500 W.

5. The method of claim 1 wherein said immersion heating element substantially reduces the growth of said scale in said storage tank, generating at least 10 wt% less scale than a metal tubular clement having a 0.315 in. diameter metal sheath and an equivalent envelope.

6. The method of claim 5 wherein said immersion heating element comprises a polymeric-coated wire.

7. The method of claim 1 wherein said immersion heating element is capable of fitting within an envelope of no greater than about 30 in.$^3$.

8. The method of claim 1 wherein said resistance heating material comprises a watt density of about 10–40 W/in.$^2$.

9. The method of claim 1 wherein said immersion heating element comprises at least a pair of layered coils made from a coated resistance wire.

10. In combination, a storage container capable of holding at least one gallon and an electrical resistance immersion heating element for heating water, comprising:

a storage container having contained therein a substantially renewable supply of water, said water containing calcium, calcium carbonate, or both, in a sufficient concentration to form a scale deposit during the heating of said water;

an electrical resistance immersion heating element mounted through a wall of said storage container, said electrical resistance immersion heating element including a resistance heating material disposed within an electrically insulating, substantially water impervious sheath to form an active element portion;

said active element portion having a self limiting upper temperature due to scale deposit induced overheating thereof, by said resistance heating material having a cross-sectional dimension of no greater than about 0.25 inches (6.35 mm); and having a watt density of no greater than about 60 W/in$^2$, while providing a total wattage rating of at least about 2500–4500 W; and said active element portion being capable of fitting within an envelope of less than about 50 in$^3$.

11. The combination of claim 10 wherein said active element portion comprises a watt density of no greater than about 10–40 W/in$^2$.

12. The combination of claim 10 wherein said active element portion comprises a Ni—Cr alloy wire coated with a fluorocarbon-based polymer.

13. The combination of claim 10 wherein said active element portion is capable of fitting within an envelope of less than 30 in$^3$, and is capable of insertion through a sidewall opening in said storage container of about 1.0–1.5 inches in diameter.

14. The combination of claim 10 wherein said immersion heating element further comprises temperature control means for controlling electrical current through said element.

15. A resistance heating clement comprising:

a resistance heating material;

an electrically insulating, substantially water impervious sheath disposed over said resistance heating material to form an active element portion;

a pair of terminal ends extending from said resistance heating material for connecting said resistance heating element to an external source of electrical power;

said active element portion defining an envelope having an envelope length less than 30 in. and a cross-sectional envelope dimension of less than 1.5 in.;

said active element portion capable of generating a total wattage of at least about 1000 W and having a self limiting upper temperature due to scale deposit induced overheating thereof, by said resistance heating material having a watt density of no greater than 60 W/in$^2$; and said active element portion by having said self limiting upper temperature being capable of substantially reducing scale production in water containing calcium, calcium carbonate, or both.

16. The resistance heating element of claim 15 wherein said active element portion comprises a polymeric-coated wire or a tubular configuration.

17. The heating element of claim 16 wherein said polymeric-coated wire or tubular configuration has an outer diameter of less than about 0.25 in.

18. The heating element of claim 16 wherein said self limiting upper temperature is about 400° F.

19. The heating element of claim 15 wherein said active element portion has a watt density of 10–40 watts/in$^2$.

20. The heating element of claim 15 wherein said active element portion comprises a resistance heating wire coated with a fluorocarbon-based polymer and having a watt density of no greater than about 20–35 watts/in$^2$ and an outer diameter of no greater than about 0.125 in.

21. A water heater comprising:

a storage container wall comprising a thermally conductive, water impervious polymeric material;

an electrical resistance heating element disposed within said storage container wall, said electrical resistance heating element including a resistance heating material which is electrically insulated from the contents of said storage container;

said electrical resistance heating element having a self limiting upper temperature due to scale deposit induced overheating thereof, by said resistance heating material having a watt density of no greater than about 60 $W/in^2$ while providing a total wattage rating of at least about 1,000 watts; and said electrical resistance heating element by having said self limiting upper temperature being capable of substantially reducing the growth of scale in said storage container.

* * * * *